US007172031B2

(12) United States Patent
Piatti

(10) Patent No.: US 7,172,031 B2
(45) Date of Patent: Feb. 6, 2007

(54) AUTOMATIC, PYROTECHIC FIRE EXTINGUISHER

(76) Inventor: Domenico Piatti, Via F.lli Bandiera 53, I-80038 Pomigliano d'Arco (IT)

( * ) Notice: Subject to any disclaimer, the term of this patent is extended or adjusted under 35 U.S.C. 154(b) by 576 days.

(21) Appl. No.: 10/168,573

(22) PCT Filed: Dec. 19, 2000

(86) PCT No.: PCT/IT00/00533

§ 371 (c)(1),
(2), (4) Date: Sep. 12, 2002

(87) PCT Pub. No.: WO01/47603

PCT Pub. Date: Jul. 5, 2001

(65) Prior Publication Data

US 2003/0047328 A1 Mar. 13, 2003

(30) Foreign Application Priority Data

Dec. 23, 1999 (IT) ..... NA99A0070

(51) Int. Cl.
*A62C 35/00* (2006.01)

(52) U.S. Cl. ..... 169/9; 169/56
(58) Field of Classification Search ..... 169/9, 169/33, 56, 60, 61, 85; 239/309
See application file for complete search history.

(56) References Cited

U.S. PATENT DOCUMENTS 3,833,063 A * 9/1974 Williams ..... 169/28
4,256,181 A * 3/1981 Searcy ..... 169/65
4,648,460 A * 3/1987 McCulloch ..... 169/57
4,760,886 A * 8/1988 Sassier ..... 169/28
5,355,026 A * 10/1994 Scofield ..... 307/117
5,590,718 A * 1/1997 Bertossi ..... 169/62
5,884,710 A * 3/1999 Barnes et al. ..... 169/46
5,915,480 A * 6/1999 Yemelyanov et al. ..... 169/61
5,918,681 A 7/1999 Thomas
5,992,528 A * 11/1999 Parkinson et al. ..... 169/6
6,076,468 A * 6/2000 DiGiacomo et al. ..... 102/530
6,189,624 B1 * 2/2001 James ..... 169/61

FOREIGN PATENT DOCUMENTS

| | | |
|---|---|---|
| DE | 27 01 935 | 7/1978 |
| EP | 1 013 308 A | 6/2000 |
| JP | 62 234766 A | 10/1987 |

* cited by examiner

*Primary Examiner*—Gene Mancene
*Assistant Examiner*—Thach H. Bui
(74) *Attorney, Agent, or Firm*—Michael J. Striker

(57) ABSTRACT

A fire extinguisher for automotive vehicles, boats, and technical environments which is either automatically controlled, in case of fire, by the action of a thermosensitive cable or, in case of front impact, by the action of a percussion pin switch or manually by a push button located in the interior compartment. It consists of a cylindrical cell box, a valve assembly, a pyrotechnic charge, a bottle of carbon dioxide. When the pyrotechnic charge is electrically energized, it explodes and the percussion pin perforates the diaphragm of the $CO_2$ bottle. The gas pressurizes the cell box and causes the extinguishing substance to flow out through a hose at the end of which a nozzle is disposed that sprinkles the extinguishing substance through a circular crown. The fire extinguisher has two small pipes within the cell box which mix $CO_2$ with the extinguishing substance.

10 Claims, 2 Drawing Sheets

14
8
11
14
2
15
8
11
7
13
12
4
CO2
3
6
5
1

AUTOMATIC, PYROTECHIC FIRE EXTINGUISHER

BACKGROUND OF THE INVENTION

Patents EP 1013308 A, JP62-234766 A and DE 2701935 A provide a pyrotechnic charge to break a membrane and to release an extinguishing agent under pressure. Patent EP 1013308 A is manually operated and must be placed outside the compartment to be protected against fire. Patent JP 62-234766 A has a punctiform sensor on the head of the fire extinguisher that should be reached by fire to be activated so that it must be placed inside the compartment to be protected against fire. Patent DE 2701935 A has no automatic control device. These patents provide the expansion of the gas developed by the pyrotechnic charge in a chamber that once pressurized causes the punch to move against a membrane. None of these patents is able to detect and to extinguish a fire that develops in any point of the compartment to be protected against fire as there is not provided any suitable sensor to control the space.

SUMMARY OF THE INVENTION

The state of the art in this field provides manual fire extinguishers and automatic installations. The extinguishers may be of several types: dust-, $CO_2$-, foam-, halons-extinguishers and the like. They may be pressurized or have a $CO_2$ or nitrogen bottle, but they always are operated manually. A particular type of fire extinguishers carries a sprinkler head instead of a valve assembly which explodes at a given temperature and opens the orifice from which the extinguishing substance flows out. Such a type of fire extinguisher cannot be remote controlled by any push button and/or switch and has to be installed directly in the apparatus to be protected.

The automatic fire extinguishing installations consist of a sensor device and an extinguishing device. The fire is sensed by field sensors connected to a sensing and extinguishing central installation.

The automatic fire extinguisher of the present invention is located in the middle between the manual fire extinguisher and the automatic fire extinguishing installation and is absolutely new. It is easy to be operated like the manual extinguishers and has the advantages of the known automatic fire-extinguishing installations.

The fire extinguisher in accordance with the present invention, which is provided for car compartments, boats, electrical, electronic, mechanical, oleodynamic or thermal apparatus in cabinets and/or closed rooms, is automatically manually activated and can be placed inside or outside the compartment to be protected against fire.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings,

DESCRIPTION OF THE PREFERRED EMBODIMENTS

Figure 1:
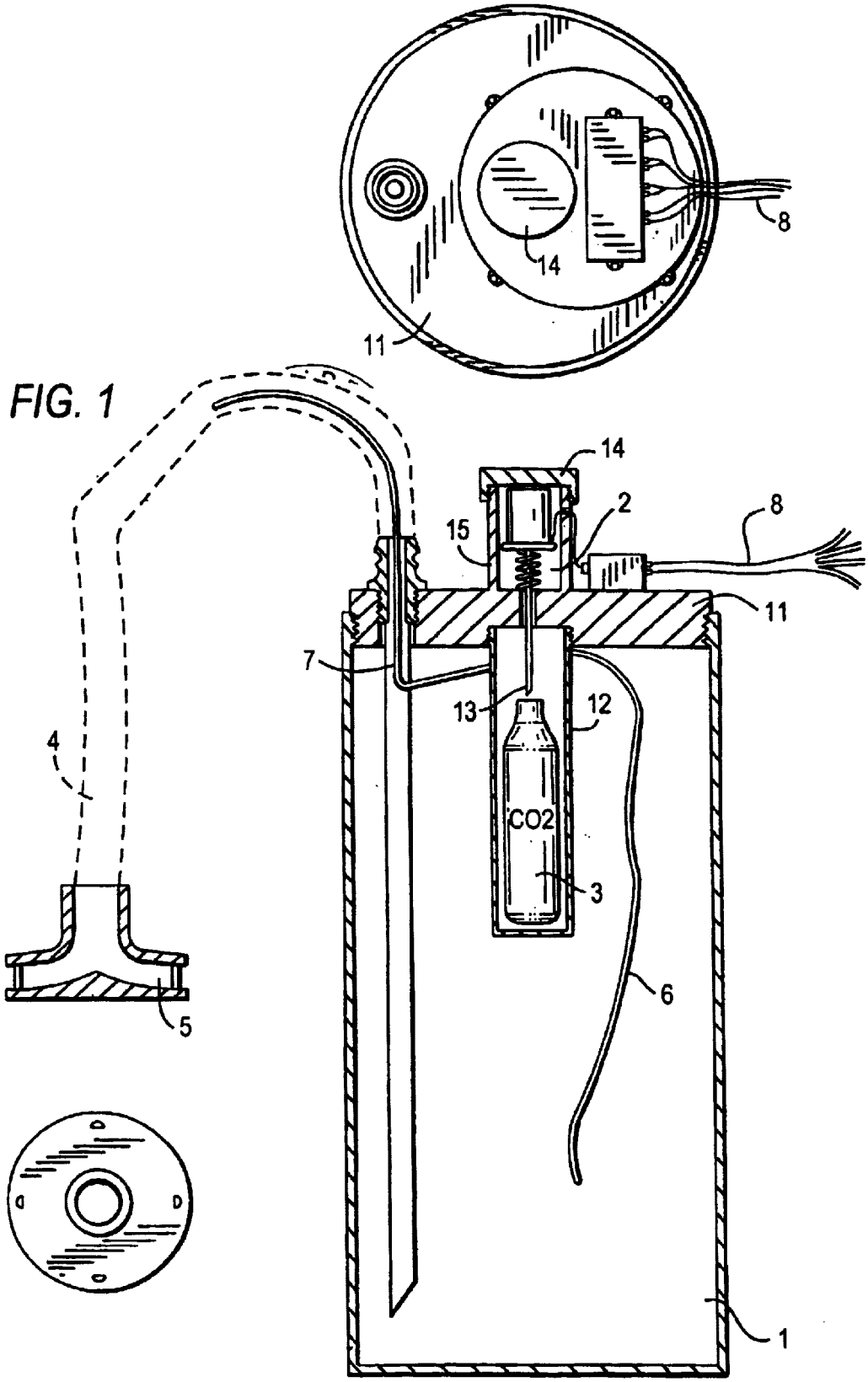
FIG. 1 is a schematic view of an automatic, pyrotechnic fire extinguisher in accordance with the invention.
Figure 2:
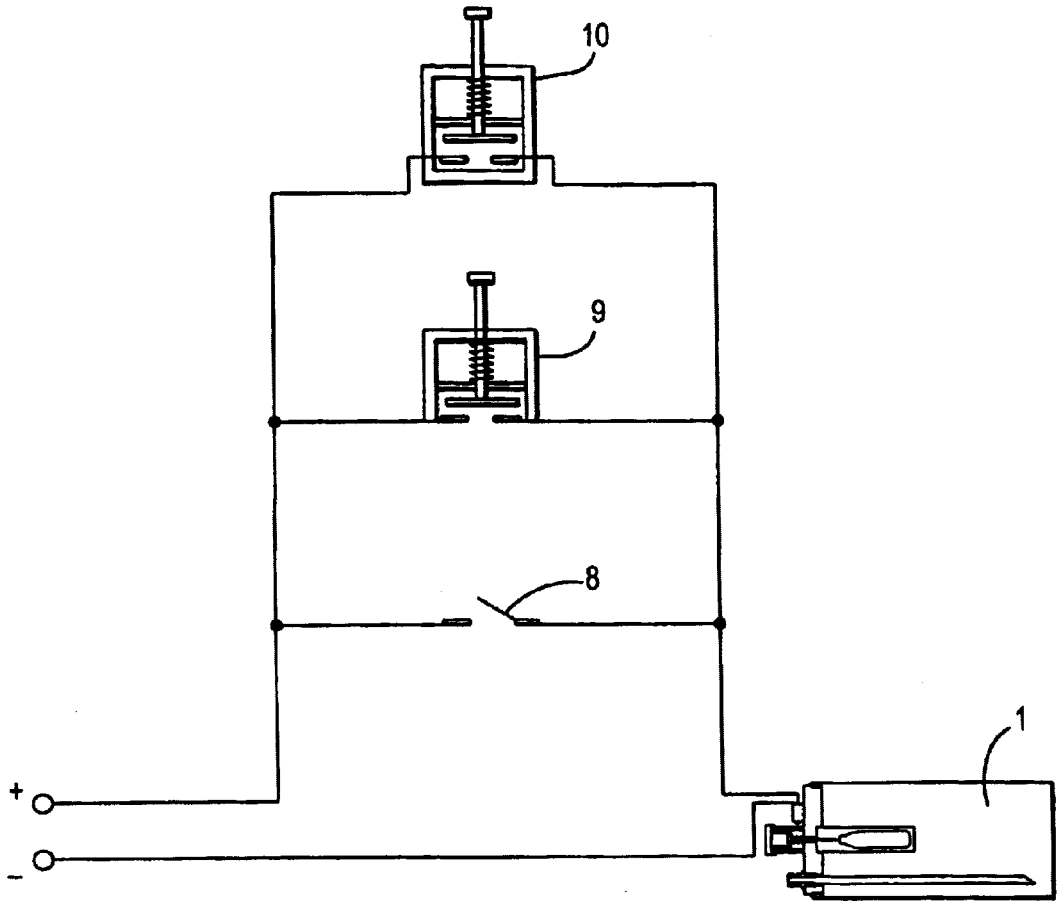
FIG. 2 is a wiring diagram of the inventive extinguisher.

The present invention relates to an extinguishing means, which is actuated automatically by means of a thermosensitive cable without any fire-fighting central device. The automatic, pyrotechnic fire extinguisher of the present invention (Tab. ½) consists of a cell box (1) containing the extinguishing substance, a valve assembly (2), a pyrotechnic charge, a bottle of liquid carbon dioxide (3), a hose (4) for supplying the extinguishing substance, a nozzle (5), two small pipes (6) and (7) within the cell box, a thermosensitive cable (8) operating as a heat sensor and having a plurality of wires, a manually controlled electrical push button (9), and a percussion pin switch (10).

The valve assembly consists of: a cylindrical threaded body (11) which is screwed to the cell box; a bottle holder (12); a percussion pin (13); a plug (14) which closes the chamber (15) acting as mortar in which the pyrotechnic charge is received.

In case of fire, when the pyrotechnic charge is electrically energized by the thermosensitive cable (8), it explodes and causes the percussion pin to perforate the diaphragm of the carbon dioxide bottle (3). The propellant contained in the bottle enters the cell box (1) and pressurizes the extinguishing substance causing the same to flow out under pressure. At the same time, $CO_2$ flows into pipes (6) and (7). The portion of $CO_2$ flowing through pipe (6) causes the extinguishing substance to swirl, while the portion flowing through pipe (7) is discharged directly to the hose where it mixes in a swirling way with the flow of the extinguishing substance. Pipe (7) is basic for the foaming.

The fire extinguisher (Tab. 2/2) may be controlled:

1) manually, by an electric push button (16) located, for example, in the interior compartment of an automotive vehicle near the driver;
2) automatically, in case of fire, by the action of the heat that shorts the thermosensitive cable (8) located above the area to be protected; e.g., in case of an automotive vehicle the cable is located under the hood panel;
3) automatically, in case of front impact, by the action of the percussion pin switch (10) located between bumper and engine.

The fire extinguisher may be located within the engine compartment in a vertical or horizontal position or within another room available in the automotive vehicle or the apparatus to be protected. By way of illustration, in operation, in the case of a vehicle compartment or a room, preferably the wires of the thermosensitive cable sensor (8) are laid entirely over the room or compartment to be protected against fire, such that thermosensitive cable sensor is short-circuited whenever heat of a fire contacts any location of the room or compartment, thereby lighting directly a pyrotechnic charge to operate the extinguishing means.

The automatic fire extinguisher can protect automotive vehicles, boats, electrical, electronic, thermal, oleodynamic apparatus, generating sets etc., and is particularly suitable for unmanned apparatus and rooms.

What is claimed is:

1. An anti-fire extinguishing apparatus for motor compartments of automotive vehicles, boats, electrical, electronic, mechanic, oleodynamic or thermal apparatus in cabinets and/or closed rooms which is manually or automatically remote controlled, comprising:

extinguishing means;

a thermosensitive cable sensor having a plurality of wires laid entirely over a room to be protected against fire, wherein said thermosensitive cable sensor is capable of causing a short circuit of the wires under an effect of heat, such that said thermosensitive cable sensor is short-circuited whenever heat of a fire contacts any location of the room, thereby lighting directly a pyrotechnic charge to operate the extinguishing means without requiring a control unit.

2. The anti-fire extinguishing apparatus of claim 1, further comprising a remote-controlled electric push button that energizes directly the pyrotechnic charge.

3. The anti-fire extinguishing apparatus of claim 1, further comprising a percussion pin switch that automatically energizes the charge in an automotive vehicle in case of front impact.

4. The anti-fire extinguishing apparatus of claim 1, wherein automatic control means are contained in a head disposed on the cell box of the fire extinguisher.

5. The anti-fire extinguishing apparatus of claim 1, wherein a pipe is near the wall of the cell box so that it can also operate when the cell box is in a horizontal position.

6. The anti-fire extinguishing apparatus of claim 1, wherein the pyrotechnic charge can be energized by voltage of a battery or a main.

7. The anti-fire extinguishing apparatus of claim 1, further comprising a nozzle with a shape that allows it to deliver the extinguishing substance over 360°.

8. The anti-fire extinguishing apparatus of claim 1, further comprising an inner pipe (6) that supplies the propellant to the extinguishing substance by mixing them in a swirling manner.

9. The anti-fire extinguishing apparatus of claim 1, further comprising a percussor, wherein an electrically operated pyrotechnic charge is laid down directly on the percussor and is provided with a return spring.

10. The anti-fire extinguishing apparatus of claim 1, further comprising a tank for containing the extinguishing means, wherein pipes are provided inside the tank that distribute propellant gas into a mass of the extinguishing means, thus forming a mixture by turbulence.

* * * * *